US010865635B2

(12) United States Patent
Singal et al.

(10) Patent No.: US 10,865,635 B2
(45) Date of Patent: Dec. 15, 2020

(54) METHOD OF CONTROLLING A GAS VENT SYSTEM FOR HORIZONTAL WELLS

(71) Applicant: General Electric Company, Schenectady, NY (US)

(72) Inventors: Kalpesh Singal, Glenville, NY (US); Deepak Aravind, Bangalore (IN); Jeremy Daniel VanDam, Edmond, OK (US); Yashwanth Tummala, Chicago, IL (US)

(73) Assignee: Baker Hughes Oilfield Operations, LLC, Houston, TX (US)

( * ) Notice: Subject to any disclaimer, the term of this patent is extended or adjusted under 35 U.S.C. 154(b) by 228 days.

(21) Appl. No.: 15/458,877

(22) Filed: Mar. 14, 2017

(65) Prior Publication Data

US 2018/0266209 A1 Sep. 20, 2018

(51) Int. Cl.

| | |
|---|---|
| ***E21B 47/06*** | (2012.01) |
| ***E21B 43/12*** | (2006.01) |
| ***E21B 34/16*** | (2006.01) |
| ***E21B 43/38*** | (2006.01) |

(52) U.S. Cl.
CPC ..... *E21B 47/06* (2013.01); *E21B 43/128* (2013.01); *E21B 43/38* (2013.01)

(58) Field of Classification Search
CPC ..... E21B 34/16; E21B 47/06; E21B 43/12
See application file for complete search history.

(56) References Cited

U.S. PATENT DOCUMENTS

| | | | |
|---|---|---|---|
| 4,632,184 A | 12/1986 | Renfroe, Jr. et al. | |
| 5,154,588 A | 10/1992 | Freet et al. | |
| 5,947,206 A | 9/1999 | McCalvin et al. | |
| 6,119,781 A | 9/2000 | Lemetayer et al. | |
| 6,273,195 B1 | 8/2001 | Hauck et al. | |
| 6,325,152 B1 | 12/2001 | Kelley et al. | |
| 6,651,740 B2 | 11/2003 | Kobylinski et al. | |
| 7,673,676 B2 | 3/2010 | Rivas et al. | |
| 8,196,657 B2 | 6/2012 | Kennedy | |
| 8,448,699 B2 | 5/2013 | Camilleri et al. | |
| 8,794,305 B2 * | 8/2014 | Wilson | E21B 43/123 166/372 |

(Continued)

FOREIGN PATENT DOCUMENTS

| | | |
|---|---|---|
| EP | 2821587 A1 | 1/2015 |
| EP | 2821588 A1 | 1/2015 |

OTHER PUBLICATIONS

Sharma et al., "Nonlinear optimization and control of an Electric Submersible Pump lifted oil field", Modelling, Identification & Control (ICMIC), 2013 Proceedings of International Conference on, pp. 26-31, 2013, Cairo.

(Continued)

*Primary Examiner* — Catherine Loikith

(74) *Attorney, Agent, or Firm* — Baker Hughes Company

(57) ABSTRACT

A method of controlling a gas vent system to vent gas from a wellbore that includes a substantially horizontal portion. The method includes determining an initial operating mode of the gas vent system; generating one or more control signals established for the determined initial operation mode; and transmitting the one or more control signals to a gas vent valve that commands the closing or opening of the gas vent valve. A controller for use in venting gas from a wellbore is additionally disclosed.

16 Claims, 10 Drawing Sheets

(56) References Cited

U.S. PATENT DOCUMENTS

| | | | |
|---|---|---|---|
| 2003/0037923 | A1 | 2/2003 | Emanuele et al. |
| 2004/0204794 | A1 | 10/2004 | Ohmi et al. |
| 2006/0081378 | A1 | 4/2006 | Howard et al. |
| 2008/0300728 | A1 | 12/2008 | Nagaoka et al. |
| 2010/0089588 | A1 | 4/2010 | Thompson |
| 2010/0307598 | A1 | 12/2010 | Cao et al. |
| 2011/0132595 | A1 | 6/2011 | Rivas et al. |
| 2013/0098629 | A1 | 4/2013 | Wilson |
| 2016/0084042 | A1 | 3/2016 | VanDam et al. |
| 2016/0177666 | A1 | 6/2016 | Van Dam et al. |

OTHER PUBLICATIONS

Maughan, James Rollins, et al., "Surface Pressure Controlled Gas Vent System for Horizontal Wells", U.S. Appl. No. 14/969,915, filed Dec. 15, 2015.

International Search Report and Written Opinion issued in connection with corresponding PCT Application No. PCT/US2018/022246 dated Jun. 26, 2018.

* cited by examiner

METHOD OF CONTROLLING A GAS VENT SYSTEM FOR HORIZONTAL WELLS

BACKGROUND

This disclosure relates generally to oil or gas producing wells, and, more specifically, the disclosure is directed to horizontal wells having a gas vent system for removing gas from a wellbore, and the control of such gas vent system.

The use of directionally drilled wells to recover hydrocarbons from subterranean formations has increased significantly in the past decade. The geometry of the wellbore along the substantially horizontal portion typically exhibits slight elevation changes, such that one or more undulations (i.e., "peaks" and "valleys") occur. In at least some known horizontal wells, the transport of both liquid and gas phase materials along the wellbore results in unsteady flow regimes including terrain-induced slugging, such as gas slugging. Fluids that have filled the wellbore in lower elevations impede the transport of gas along the length of the wellbore. This phenomenon results in a buildup of pressure along the length of the substantially horizontal wellbore section, reducing the maximum rate at which fluids can enter the wellbore from the surrounding formation. Continued inflow of fluids and gasses cause the trapped gas pockets to build in pressure and in volume until a critical pressure and volume is reached, whereby a portion of the trapped gas escapes past the fluid blockage and migrates as a slug along the wellbore. Furthermore, at least some known horizontal wells include pumps that are designed to process pure liquid or a consistent mixture of liquid and gas. Not only does operating the pump without pure liquids cause much lower pumping rates, but it may also cause damage to the pump or lead to a reduction in the expected operational lifetime of the pump.

To cope with this type of terrain-induced slugging, one recently developed technique includes the utilization of a gas vent tube, situated within the wellbore, that includes one or more mechanical valves distributed at various gas tube access points throughout the length of the wellbore. Each mechanical valve within the wellbore, for this technique, is capable of remaining closed in the presence of liquid and opening passage to the gas tube vent in the absence of liquid. In this manner, those mechanical valves located in a "valley" or at a relatively lower elevation horizontal wellbore undulation are configured to remain closed, preventing the ingress of liquid into the gas vent tube. On the other hand, those mechanical valves located at a "peak" or at a relatively higher elevation horizontal wellbore undulation are configured to open automatically to allow gas to enter the gas vent tube and escape to the surface. These mechanical valves may be passive valves or may be active valves that include one or more sensors (e.g., fluid sensors) to assist in determining the actuation of one or more valves. However, the reliability of mechanical valves, especially when thousands of feet under the surface, is problematic. Moreover, the utilization of active mechanical valves in a gas vent tube becomes even more cumbersome since a power supply and power delivery to each downhole active valve is required. Furthermore, the opening and closing of such mechanical valves in known gas venting systems must be controlled, so that the amount of gas that is vented out is controlled. The venting of too much gas or too little gas may lead to stability issues within the venting system, and/or the well system itself.

Accordingly, it is desired to provide an improved gas vent system for use in a horizontal well for removing gas from a wellbore. It is additionally desired the improved gas vent system include means for controlling the amount of gas to be vented.

BRIEF DESCRIPTION

Various embodiments of the disclosure include a gas vent system and means for controlling such system and methods of controlling the gas vent system.

In accordance with one exemplary embodiment, disclosed is a method of controlling a gas vent system to vent gas from a wellbore. The wellbore includes a substantially horizontal portion and is configured to channel a mixture of fluids. The method includes determining an initial operating mode of the gas vent system; generating one or more control signals established for the determined initial operation mode; and transmitting the one or more control signals to a gas vent valve that commands the closing or opening of the gas vent valve.

In accordance with another exemplary embodiment, disclosed is a method of controlling a gas vent system to vent gas from a wellbore. The wellbore includes a substantially horizontal portion and is configured to channel a mixture of fluids. The method includes determining an initial operating mode of the gas vent system by determining an initial target downhole pressure (PDH) set point, setting a gas venting rate to fluctuate above and below the initial target downhole pressure (PDH) set point and measuring and comparing a dynamic response of the downhole pressure (PDH) to the gas venting rate; generating one or more control signals established for the determined initial operation mode; and transmitting the one or more control signals to a gas vent valve that commands the closing or opening of the gas vent choke valve.

In accordance with yet another exemplary embodiment, disclosed is a controller for use in venting gas from a wellbore. The wellbore includes a substantially horizontal portion and is configured to channel a mixture of fluids. The controller is configured to determine an initial operating mode of the gas vent system by determining the downhole pressure (PDH) and a gas venting rate of the gas vent system; generate one or more control signals established for the determined initial operation mode; and transmit the one or more control signals to a gas vent valve that commands the closing or opening of the gas vent valve.

Other objects and advantages of the present disclosure will become apparent upon reading the following detailed description and the appended claims with reference to the accompanying drawings. These and other features and improvements of the present application will become apparent to one of ordinary skill in the art upon review of the following detailed description when taken in conjunction with the several drawings and the appended claims.

DRAWINGS

These and other features, aspects, and advantages of the present disclosure will become better understood when the following detailed description is read with reference to the accompanying drawings in which like characters represent like parts throughout the drawings, wherein.

Figure 1:
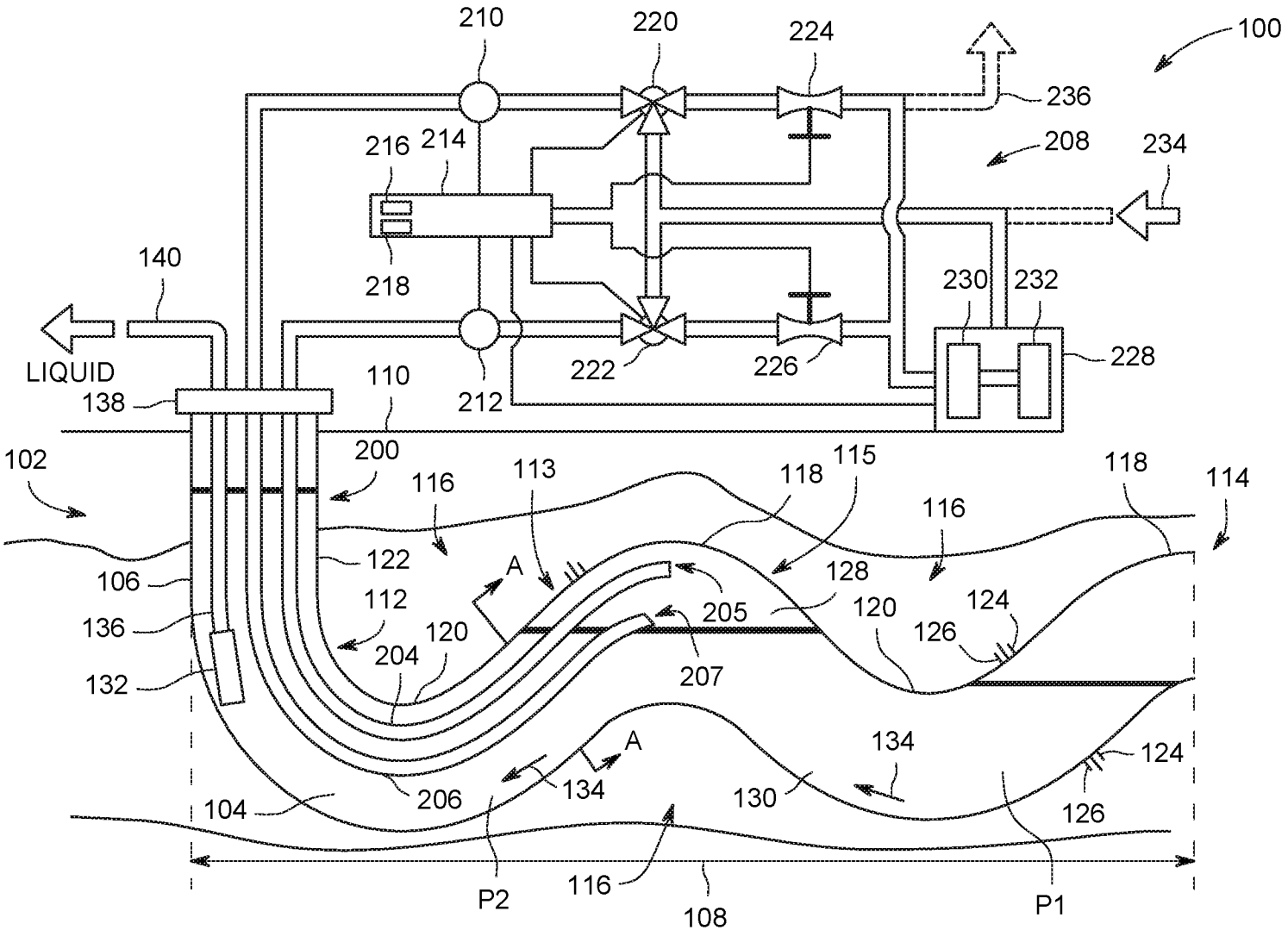
FIG. 1 is a schematic view of an exemplary horizontal well including a gas vent system, in accordance with one or more embodiments shown or described herein.
Figure 6:
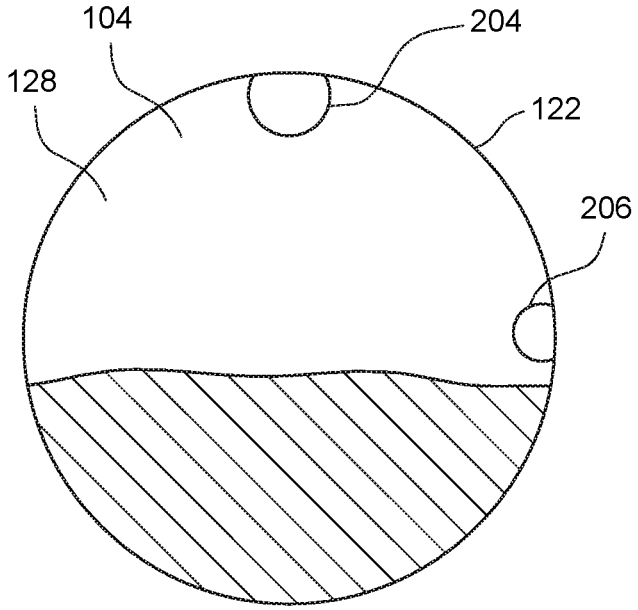
Figure 7:
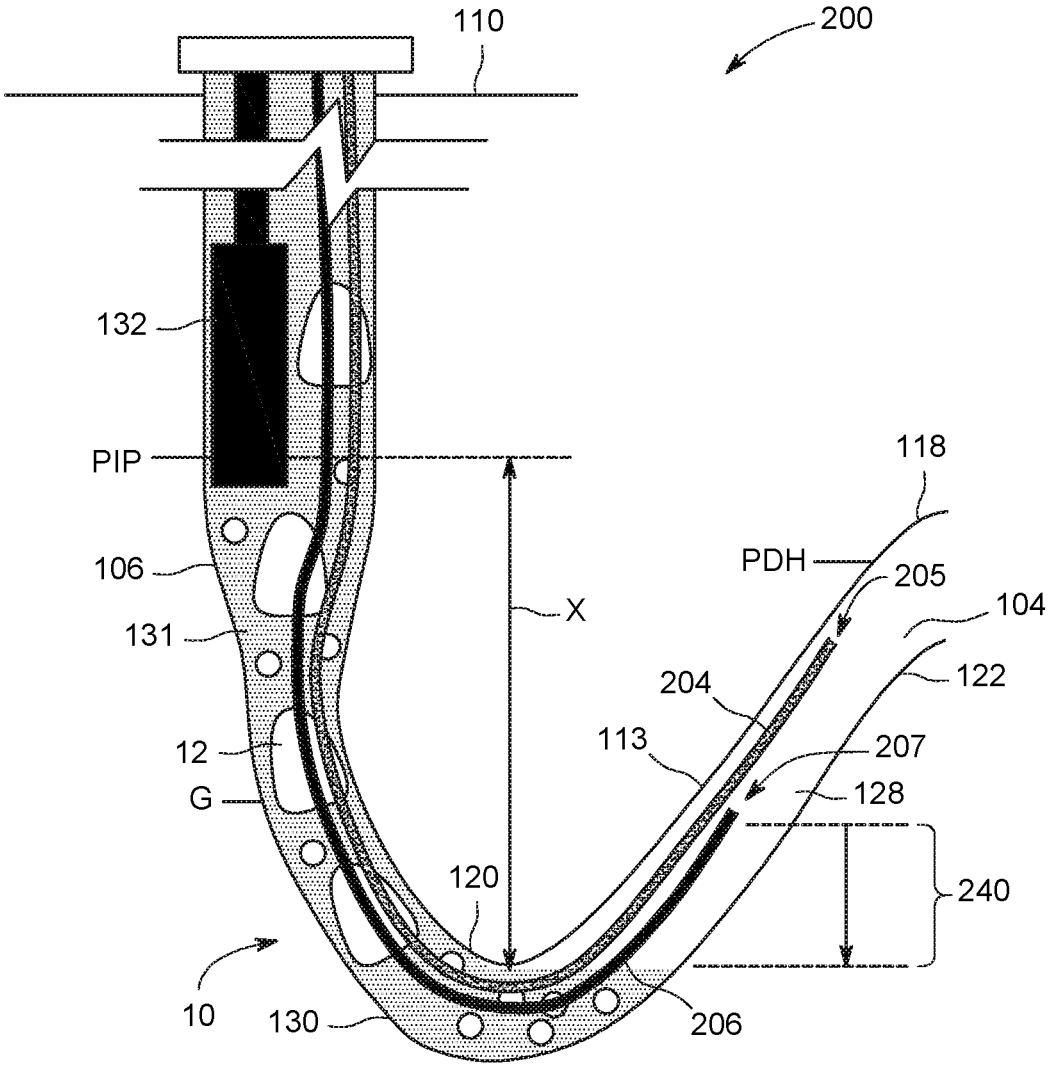
Figure 8:
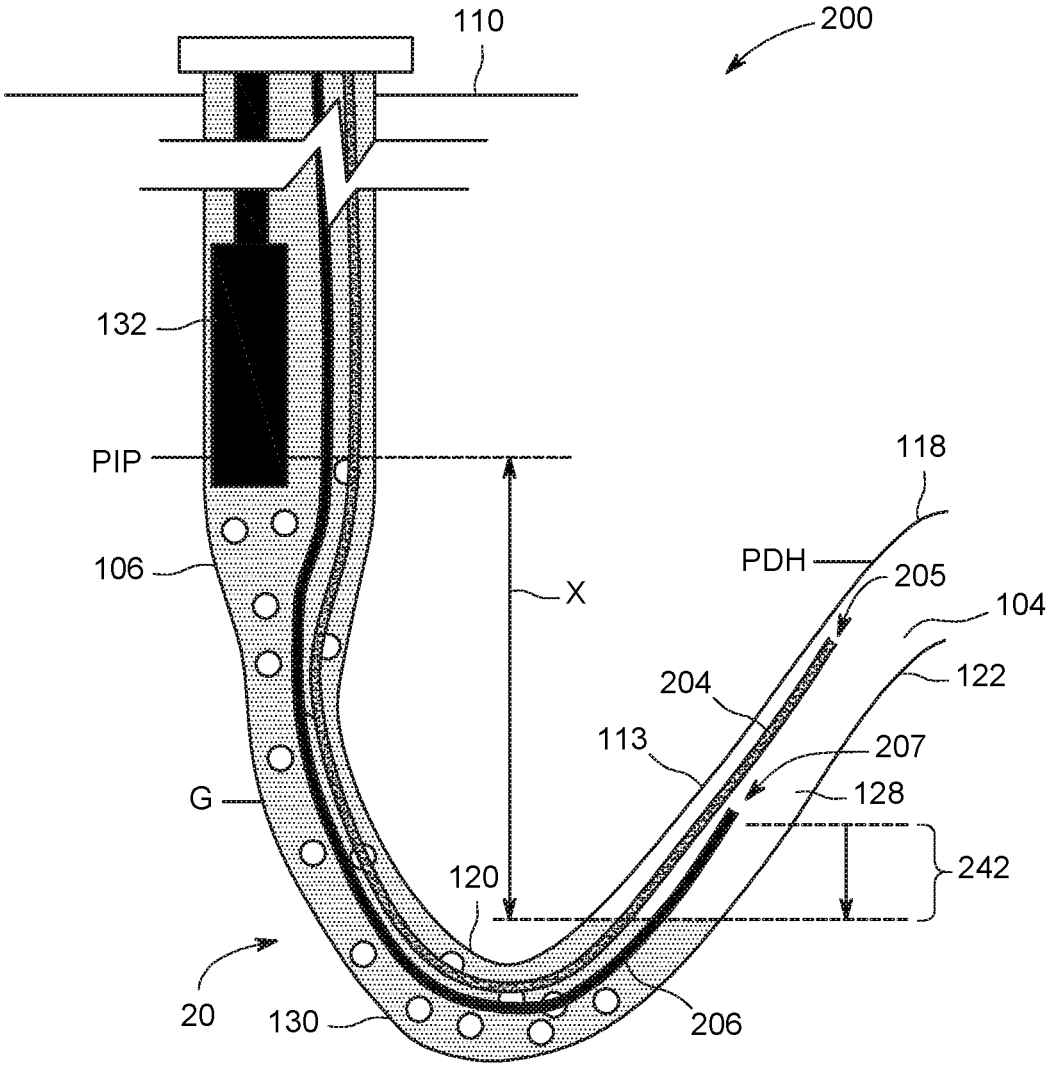
Figure 9:
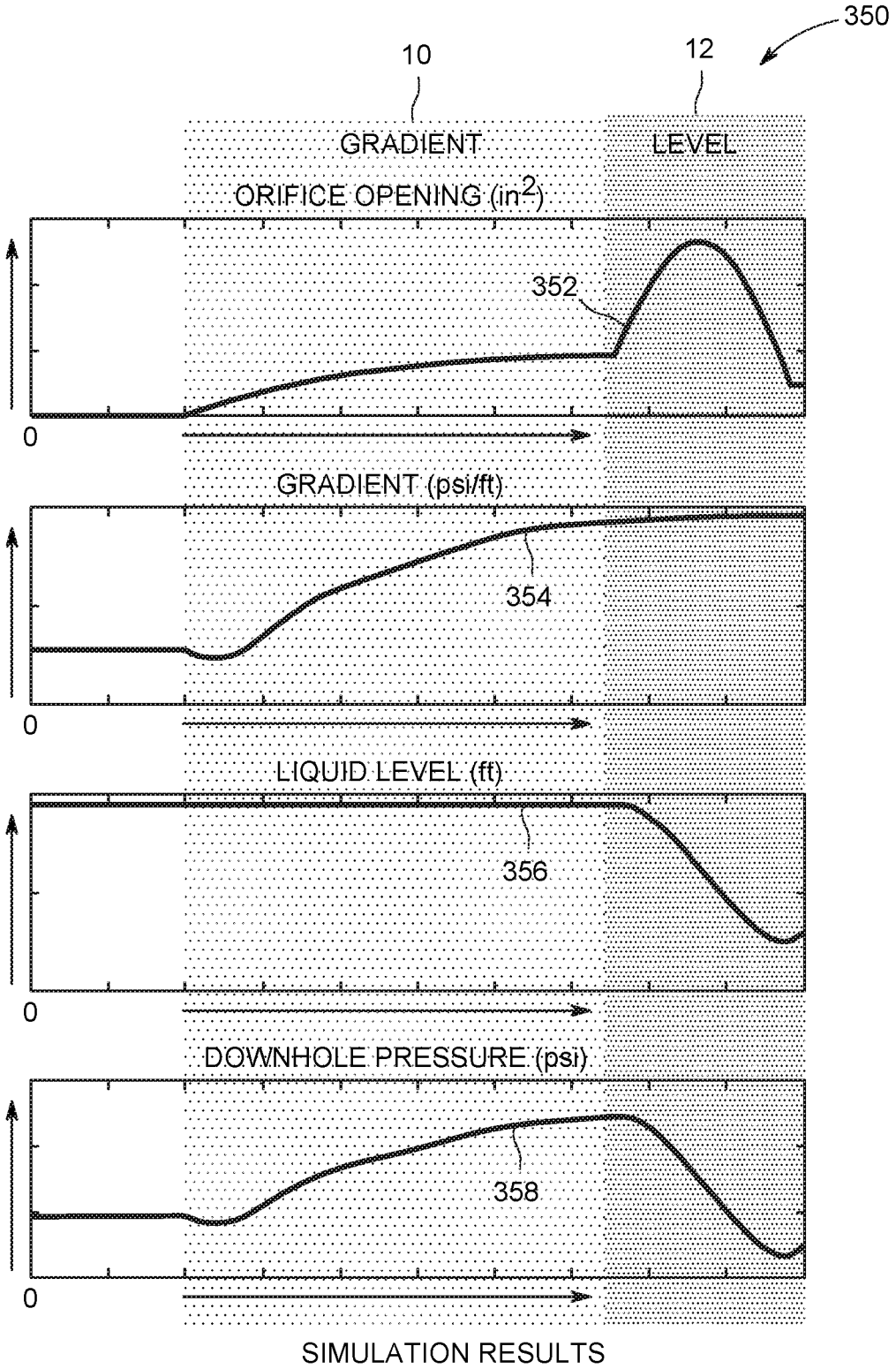
Figure 10:
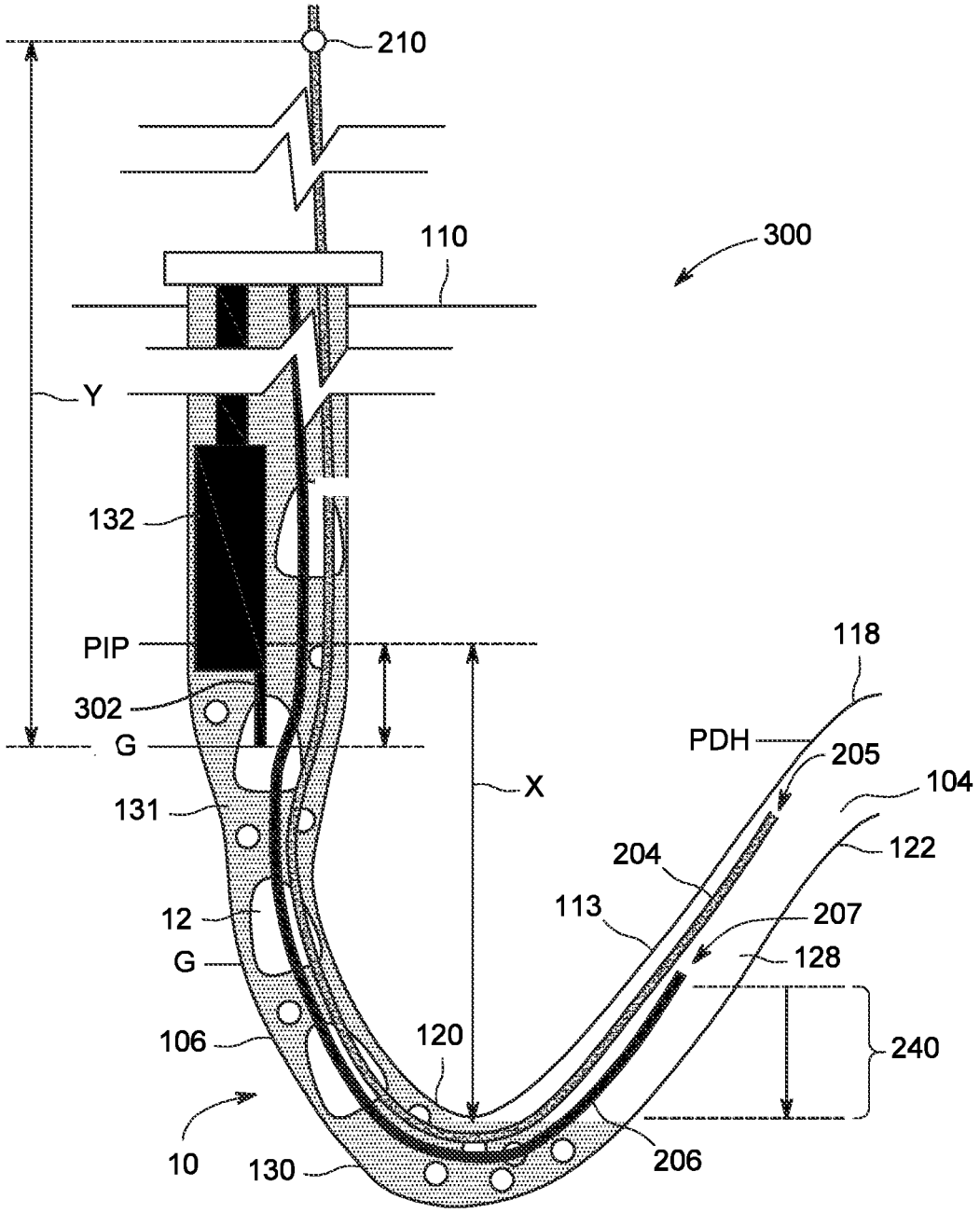
Figure 11:
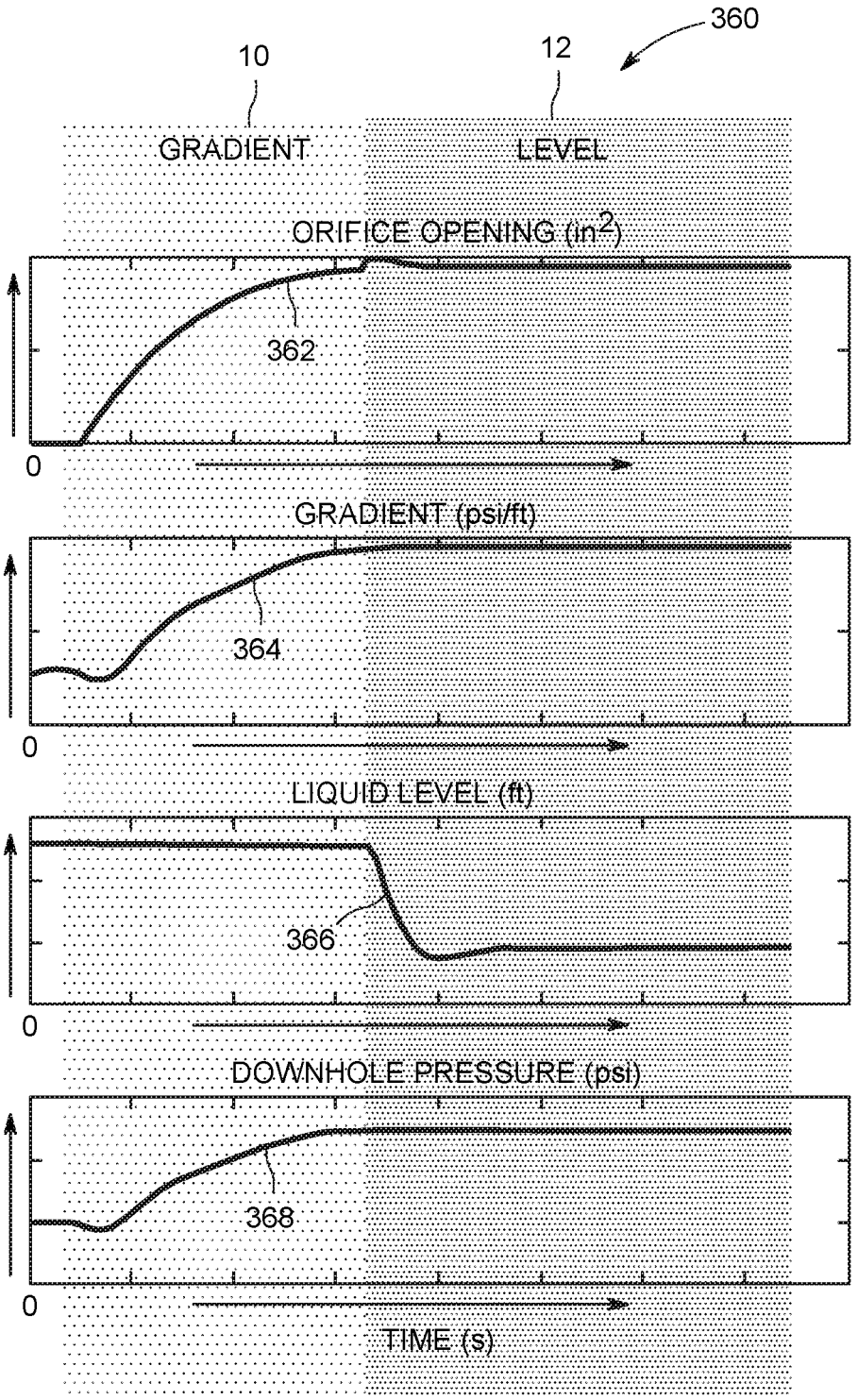
Figure 12:
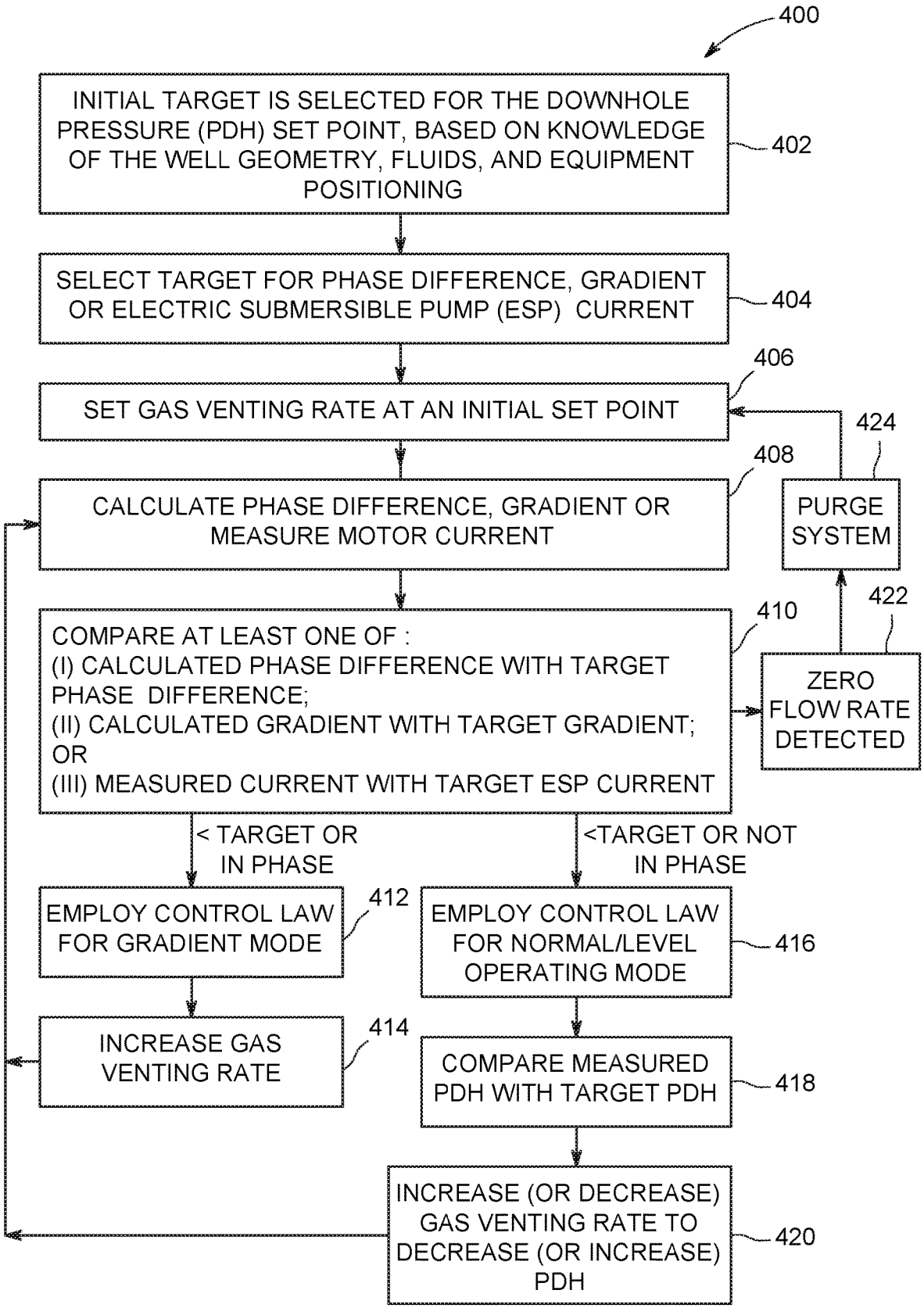

FIG. 6 is a cross-sectional view of a portion of another alternative gas vent system that may be used with the horizontal well shown in FIG. 1, in accordance with one or more embodiments shown or described herein; and FIG. 7 is a schematic view of a portion of the gas vent system shown in FIG. 1 in a startup, or gradient, mode of operation, in accordance with one or more embodiments shown or described herein;

FIG. 8 is another schematic view of a portion of the gas vent system well shown in FIG. 1 in a normal, or level, mode of operation, in accordance with one or more embodiments shown or described herein;

FIG. 9 is a graphical representation illustrating simulation results in the gas vent system, in accordance with one or more embodiments shown or described herein;

FIG. 10 is another schematic view of a portion of the gas vent system in a startup, or gradient, mode of operation, including a sensor disposed adjacent a downhole electric submersible pump (ESP), in accordance with one or more embodiments shown or described herein;

FIG. 11 is a graphical representation illustrating simulation results in the gas vent system, including a forward deployed sensor based control, in accordance with one or more embodiments shown or described herein; and FIG. 12 is a flowchart illustrating a method of controlling a gas vent system to vent gas from a wellbore, in accordance with one or more embodiments shown or described herein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

It is noted that the drawings as presented herein are not necessarily to scale. The drawings are intended to depict only typical aspects of the disclosed embodiments, and therefore should not be considered as limiting the scope of the disclosure. In the drawings, like numbering represents like elements between the drawings.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations are combined and interchanged. Such ranges are identified and include all the sub-ranges contained therein unless context or language indicates otherwise.

As used herein, the terms "processor" and "computer," and related terms, e.g., "processing device," "computing device," and "controller" are not limited to just those integrated circuits referred to in the art as a computer, but broadly refers to a microcontroller, a microcomputer, a programmable logic controller (PLC), and application specific integrated circuit, and other programmable circuits, and these terms are used interchangeably herein. In the embodiments described herein, memory may include, but it not limited to, a computer-readable medium, such as a random access memory (RAM), a computer-readable non-volatile medium, such as a flash memory. Alternatively, a floppy disk, a compact disc-read only memory (CD-ROM), a magneto-optical disk (MOD), and/or a digital versatile disc (DVD) may also be used. In addition, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program storage in memory for execution by personal computers, workstations, clients, and servers.

As used herein, the term "non-transitory computer-readable media" is intended to be representative of any tangible computer-based device implemented in any method of technology for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including without limitation, volatile and non-volatile media, and removable and non-removable media such as firmware, physical and virtual storage, CD-ROMS, DVDs, and any other digital source such as a network or the Internet, as well as yet to be developed digital means, with the sole exception being transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

The horizontal well systems described herein facilitate efficient methods of well operation. Specifically, in contrast to many known well operations, the horizontal well systems as described herein substantially remove gaseous substances from a wellbore in a controlled manner to substantially reduce the formation of gas slugs. More specifically, the horizontal well systems described herein include a gas vent system that includes at least one gas vent conduit positioned to include a gas vent intake passage in a horizontal portion of a wellbore. Moreover, in some embodiments, the gas vent system may include a gas probe conduit positioned to include a gas probe intake passage in the horizontal portion of the wellbore. In an embodiment, the gas vent conduit is coupled to a gas vent choke valve, situated outside the wellbore. In other embodiments, the gas probe conduit may be coupled to a gas probe choke valve, situated outside the wellbore, that facilitates a flow of gaseous substances to the surface.

The horizontal well systems described herein are inherently bimodal systems, i.e. the same action can have two different and opposite effects depending upon the state of the system. More particularly, during operation of the gas vent system, when gas slugs are present, or when the system is "slugging", typically in a startup, or gradient, mode of operation, the opening of the choke valve causes the downhole pressure (PDH) to increase. In contrast, when gas slugs are not present, or when the system is not "slugging", typically in a normal, or level, mode of operation, the opening of the choke valves causes the downhole pressure (PDH) to decrease. Accordingly, execution of control laws established for each operation mode, such as a startup and stable operational control sequence, facilitate and control the flow of gaseous substances to the surface.

To provide such control of the gas vent system, and more particularly the choke valve, an initial determination of the operation mode is made by a controller. In response, the controller generates one or more control signals established for the determined operation mode, and transmits the control signal(s) to the gas vent choke valve or the gas probe choke valve that command the closing or opening of the passage (s), such as via an actuator. To provide such mode determination, the controller may receive flow (and/or pressure) measurement signals from one or more sensors positioned to monitor the flow (and/or pressure) of the passage of gaseous substances through the gas vent conduit and gas probe conduit, respectively. Advantageously, the gas vent system facilitates for more efficient removal of gaseous substances from the horizontal portion of a wellbore, and thus, reducing or eliminating the presence (and problems) of gas slugs in a liquid well operation. As a result, the more efficient removal of liquid through quicker liquid flow rates and longer lifespans of the liquid pump are facilitated.

In response to the control of the choke valve(s), the gas vent systems described herein provide gaseous substances with an escape path that bypasses the pump and removes substantially all of the gaseous substances from within the horizontal portion of the wellbore prior to the gases reaching the pump such that only the liquid mixture encounters the pump. If the pump is set at a depth with some elevation above the depth of the gas vent intake, then some gas may break out of solution as the fluid reaches the pump, but existing pump technologies have been shown to operate successfully with limited quantities of gas bubbles that are well mixed with the fluid. The breakout gas will not form large gas slugs that interfere with pump performance. Alternatively, the gas vent systems described herein are used in horizontal wells that seek to recover only gaseous substances, and, therefore, do not include a pump. Accordingly, the gas vent systems described herein provide for a controller capable of determining an initial operation mode and generating and transmitting one or more control signals established for the determined operation mode) to the gas vent choke valve or the gas probe choke valve that command the closing or opening of the passage(s) via an actuator. The controlled gas venting as described herein substantially eliminates both the buildup of pressure upstream from the pump and the formation of slugs, as described above. The gas vent system described herein substantially reduces the buildup of pressure within the wellbore such that the horizontal portion of the wellbore achieves a nearly constant minimum pressure along its length and enables a maximized production rate and total hydrocarbon recovery of the horizontal well.

FIG. 1 is a schematic illustration of an exemplary horizontal well system 100 for removing materials from a well 102. In the exemplary embodiment, the well 102 includes a wellbore 104 having a substantially vertical portion 106 and a substantially horizontal portion 108. The vertical portion 106 extends from a surface level 110 to a heel 112 of the wellbore 104. The horizontal portion 108 extends from the heel 112 to a toe 114 of the wellbore 104. In the exemplary embodiment, the horizontal portion 108 follows a stratum 116 of hydrocarbon-containing material formed beneath surface 110, and, therefore, includes a plurality of peaks 118 and a plurality of valleys 120 defined between the heel 112 and the toe 114. Moreover, the horizontal portion 108 may include an inclined region, and more particularly an updip 113 (i.e., a portion sloping upward in elevation between a valley and a peak toward the toe 114), and a downdip 115 (i.e., a portion sloping downward in elevation between a peak and a valley toward the toe 114). As used herein, the term "hydrocarbon" collectively describes oil or liquid hydrocarbons of any nature, gaseous hydrocarbons, and any combination of oil and gas hydrocarbons.

The wellbore 104 includes a casing 122 that lines portions 106 and 108 of the wellbore 104. The casing 122 includes a plurality of perforations 124 in the horizontal portion 108 that define a plurality of production zones 126. Hydrocarbons from the stratum 116, along with other liquids, gases, and granular solids, enter the horizontal portion 108 of the wellbore 104 through the plurality of production zones 126 through the plurality of perforations 124 in the casing 122 and substantially fills the horizontal section 108 with these substances 128 and a mixture 130 of liquids and granular solids. In the exemplary embodiment, "liquid" includes water, oil, fracturing fluids, or any combination thereof, and "granular solids" include relatively small particles of sand, rock, and/or engineered proppant materials that can be channeled through the plurality of perforations 124.

The horizontal well system 100 also includes an electric submersible pump (ESP) 132 positioned proximate the heel 112 of the wellbore 104. The pump 132 is configured to draw the liquid mixture 130 through the horizontal portion 108 such that the liquid mixture 130 flows in a direction 134 from the toe 114 to the heel 112. The pump 132 is fluidly coupled to a production tube 136 that extends from a wellhead 138 of the well 102. The production tube 136 is fluidly coupled to a liquid removal line 140 that leads to a liquid storage reservoir (not shown), for example. In one embodiment, the liquid removal line 140 may include a filter (not shown) to remove the granular solids from liquid mixture 130 within the line 140. Pump 132 is operated by a driver mechanism (not shown) that permits the pumping of liquid mixture 130 from the wellbore 104. In operation, the liquid mixture 130 travels from the pump 132, through the production tube 136 and 1 the liquid removal line 140.

In the exemplary embodiment, the horizontal well system 100 further includes a gas vent system 200 that is configured to channel primarily the gaseous substances 128 from within the horizontal portion 108 of the wellbore 104 such that the gaseous substances 128 are provided with an escape path from the wellbore 104 that is independent of an escape path, i.e., the production tube 136, for the liquid mixture 130. The gas vent system 200 includes a gas vent conduit 204 including a gas vent intake passage 205 and a gas probe conduit 206 including a gas probe intake passage 207, both conduits that are coupled to surface equipment 208. In the exemplary embodiment, the gas vent conduit 204 is configured to channel primarily the gaseous substances 128 from within the horizontal portion 108 of the wellbore 104 through the wellhead 138 to the surface equipment 208. Generally, the gas vent conduit 204 channels the gaseous substances 128 to any location that facilitates operation of the gas vent system 200 as described herein. Both the gas vent intake passage 205 and the gas probe intake passage 207 may be positioned in different orientations from each other, such as being situated at different elevations or different locations within the wellbore 104.

The surface equipment 208 includes a gas probe control valve 220 (e.g., three-way valve) coupled to gas probe conduit 206 that channels the gaseous substances 128 to a gas multiplier 228 or alternatively, a gas storage tank (not shown). Furthermore, the gas probe control valve 220 is coupled to a gas probe choke valve 224 or any other suitable high-pressure valve for controlling the flow rate of gaseous substances 128 and, in turn, the gas probe choke valve 224 is coupled to the gas multiplier 228. In another embodiment, the gas probe control valve 220 may be replaced with an orifice located outside the wellbore so that the gas probe conduit 206 may freely facilitate gaseous substances from the wellbore 104 to surface. Likewise, the surface equipment 208 includes a gas vent control valve 222 (e.g., three-way valve) coupled to the gas vent conduit 204 that channels the gaseous substances 128 to the gas multiplier 228 or alternatively, a gas storage tank (not shown). Moreover, the gas vent control valve 222 is coupled to a gas vent choke valve 226 (or any other suitable high-pressure valve for controlling the flow rate of gaseous substances 128) and, in turn, the gas vent choke valve 226 is coupled to the gas multiplier 228. The gas multiplier 228 includes a gas pressurizer 230 (or gas accumulator) and a pressurized gas purge tank 232 and facilitates the purging of the gas vent conduit 204 and/or the gas probe conduit 206. Additional information on the purging of the gas vent conduit 204 and/or the gas probe conduit 206 is described presently.

Additionally, surface equipment 208 includes sensors 210, 212, such that sensor 210 is coupled to gas probe conduit 206 and sensor 212 is coupled to gas vent conduit 204. These sensors 210, 212 includes a flow sensor or meter of any type, such as a turbine flow meter, Venturi meter, optical flow meters, or any other suitable flow meter, that operably measures or quantifies the rate of flow of gaseous substances through a conduit and generate an electronic signal (e.g., digital or analog). This periodic or aperiodic electronic signal is generated at a substantially instantaneous flow rate measurement or includes a delay. Alternatively or additionally, sensors 210, 212 include a pressure sensor of a type (e.g., manometer, piezoelectric, capacitive, optical, electromagnetic, etc.) that measures a pressure of the gas in the conduit.

Moreover, a process controller 214 is communicatively coupled to sensors 210, 212 and includes a processor 216 and a memory 218 that are configured to receive and store measurement monitoring signals from the sensors 210, 212. In turn, processor 216 and memory 218 executes control routines or loops to initially determine a mode of operation (described presently) of the gas vent system 200 and generate one or more control signals to control one or more of the choke valves 224, 226, and any additional piece of the surface equipment 208 (discussed below). These control routines, executed by controller 214 via processor 216 and memory 218, are configured to determine the mode of operation, and generate in response thereto, one or more control signals based any number of control algorithms or techniques, such as proportional-integral-derivative (PID), fuzzy logic control, model-based techniques (e.g., Model Predictive control (MPC), Smith Predictor, etc.), or any other control technique including adaptive control techniques.

One of the challenges in control of the gas vent system 200, as previously alluded to, is that the system is inherently a bimodal system. It is characterized by irregular flows and surges from the accumulation of the gas substances 128 and the mixture 130 of liquids and granular solids in any cross-section of the horizontal portion 108 of the horizontal well system 100. When irregular flows and surges occur in the horizontal portion 108 due to the accumulation of the gas substances 128 and the mixture 130 of liquids and granular solids, also referred to herein as slugging, the opening of the choke causes the downhole pressure (PDH) to increase, however when the system is not slugging, it causes the downhole pressure (PDH) to decrease. This makes for a complex system to control.

As shown in FIG. 1, during operation of horizontal well system 100, substances 128 and 130 enter horizontal portion 108 of wellbore 104 through production zones 126 such that the more dense mixture of liquids and granular solids collect in valleys 120 of portion 108 and less dense gaseous substances 128 collect in peaks 118. Accordingly, gas vent conduit 204 and gas probe conduit 206 of gas vent system 200 provide gaseous substances 128 with an escape path that bypasses pump 132 and removes a majority of gaseous substances 128 from within horizontal portion 108 of wellbore 104 prior to gases 128 reaching pump 132 such that only a substantially liquid mixture 130 encounters pump 132. Therefore, gas vent system 200 substantially eliminates the formation of slugs, described above, and reduces gas intake of pump 132. Despite FIG. 1 only showing one gas vent conduit 204 and one gas probe conduit 206, any number of pairs of gas vent conduits and gas probe conduits may be utilized at each gas pocket of each peak 118, or updip 113, to remove the gaseous substances 128 from each peak 118. Alternatively, in some embodiments, the gas vent system 200 utilizes only one gas vent conduit per gas pocket of each peak 118.

More specifically, the gas vent system 200 substantially reduces the buildup of pressure within the horizontal portion 108 of the wellbore 104 such that a pressure at a first point P1, proximate toe 114, is substantially similar to a pressure at a second point P2, proximate the heel 112. More specifically, the gas vent system 200 removes the increase in pressure along the horizontal portion 108 due to liquid blockage of pressurized gas pockets. However, some pressure differences along portion 108 will remain due to elevation changes and the weight of liquid mixture 130, where lower elevations have higher pressures. As a result, each production zone 126 along the horizontal portion 108 has a substantially uniform production rate with respect to wellbore pressure rather than the production zones 126 proximate the heel 112 and point P2 having significantly higher production rates than the production zones 126 proximate the toe 114 and point P1. A high-pressure pipeline 234 may also be utilized in purging either conduit 204, 206. Additionally or alternatively, any excess gaseous substances 128 evacuated from the wellbore may be disposed of through a flare 236.

Figure 2:
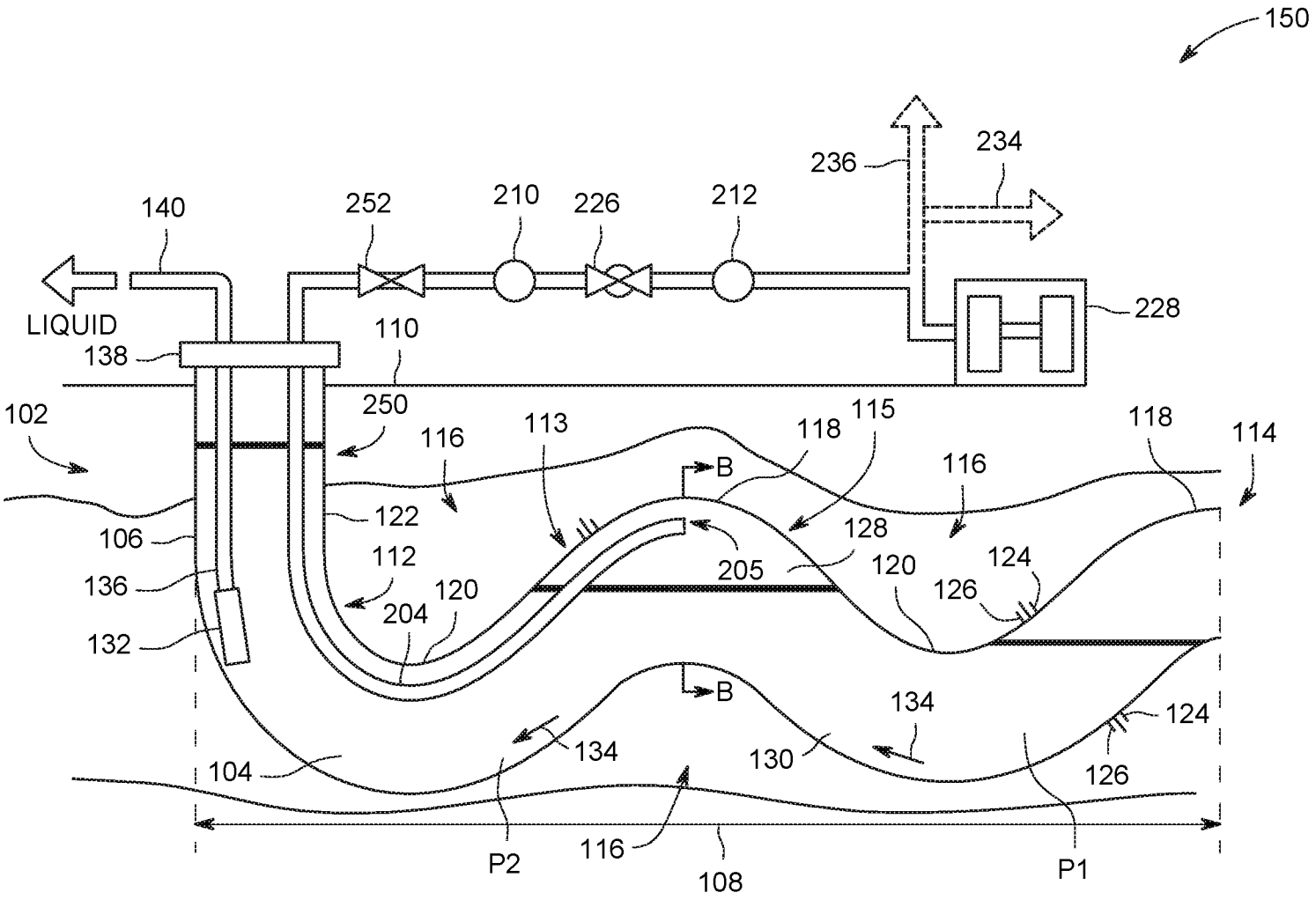
FIG. 2 is a schematic view of an exemplary horizontal well including an alternate embodiment of a gas vent system, in accordance with one or more embodiments shown or described herein.

Illustrated in FIG. 2 is an alternate embodiment of a horizontal well system, referenced 150, in which a single venting conduit is included. As best illustrated in FIG. 2, a gas vent system 250 is configured generally similar to the previously described embodiment and accordingly, similar elements will not be described. In this particular embodiment, the gas vent system 250 includes a single venting conduit 204, such as previously described. In the gas vent system 250, two pressure sensors, and more particularly, a sensor 210 is located upstream of the adjustable gas vent choke valve 226 (or any other suitable high-pressure valve for controlling the flow rate of gaseous substances 128) and a sensor 212 is located downstream of the adjustable gas vent choke valve 226. As previously described, the gas vent choke valve 226 is coupled to the gas multiplier 228. The adjustable flowrate (choke) valve 226 may include a pressure sensor of a type (e.g., manometer, piezoelectric, capacitive, optical, electromagnetic, etc.) that measures a pressure of the gas in the conduit 204. Further, as illustrated the gas vent system 250 may include a purge valve 252. A high-pressure pipeline 234 may also be utilized in purging conduit 204. Additionally or alternatively, any excess gaseous substances 128 evacuated from the wellbore may be disposed of through a flare 236.

Figure 3:
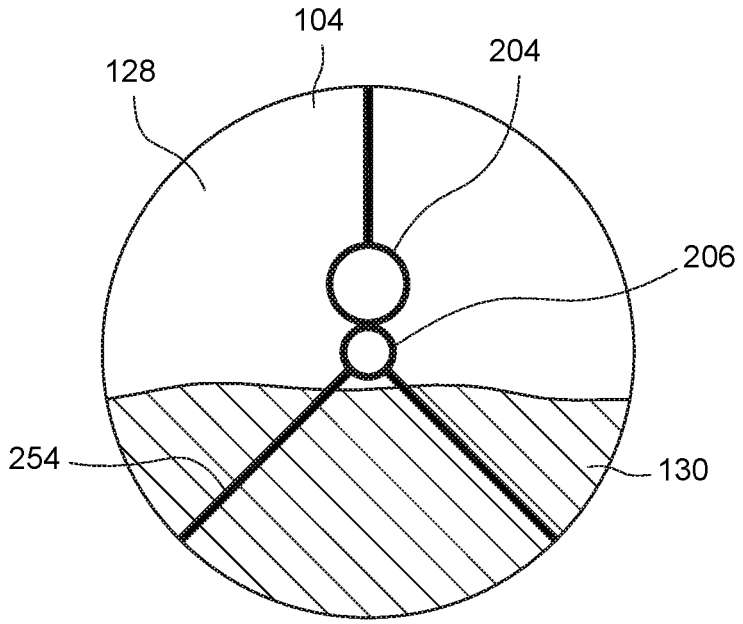
FIG. 3 is a cross-sectional view of a portion of the gas vent system shown in FIG. 1, in accordance with one or more embodiments shown or described herein.

Illustrated in FIG. 3 is a cross-sectional view of a portion of the gas vent system 200 as shown in FIG. 1 along line "A-A". The wellbore 104 includes a plurality of spacers 254 that allow for the precise positioning of the gas vent conduit 204 and the gas probe conduit 206 within the wellbore 104. The spacers 254 may be constructed from any type of suitable material and may be configured in any way to allow for the positioning of the conduits 204, 206. As shown in FIG. 3, both the conduits 204, 206 are situated above the liquid level 130 in the gaseous substance 128 headspace to allow for the gaseous substances 128 to evacuate. For example, the gas vent system preferably positions the gas vent conduit 204 (and the gas vent intake passage 205) at a higher elevation at peak 118 than the gas probe conduit 206 (and the gas probe intake passage 207). Additionally, as shown in FIG. 3, the diameter of the gas vent conduit 204 may be a different size from the diameter of the gas probe conduit 206.

Figure 4:
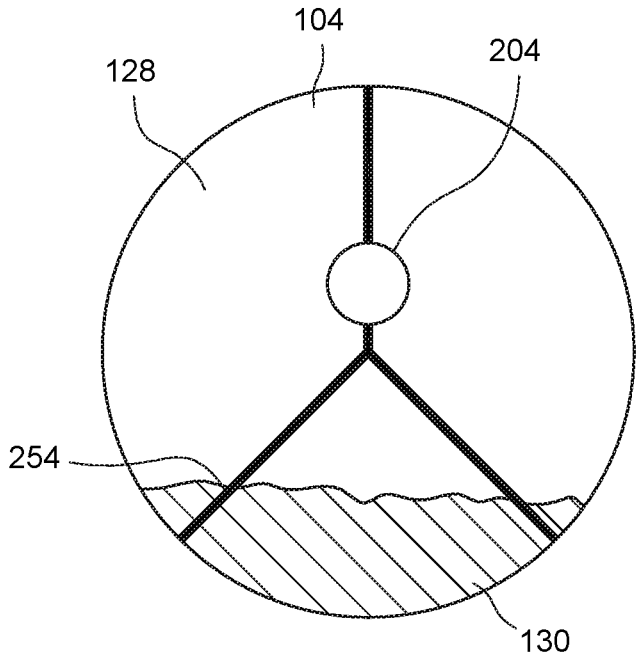
FIG. 4 is another cross-sectional view of a portion of the gas vent system shown in FIG. 1, in accordance with one or more embodiments shown or described herein.
Figure 5:
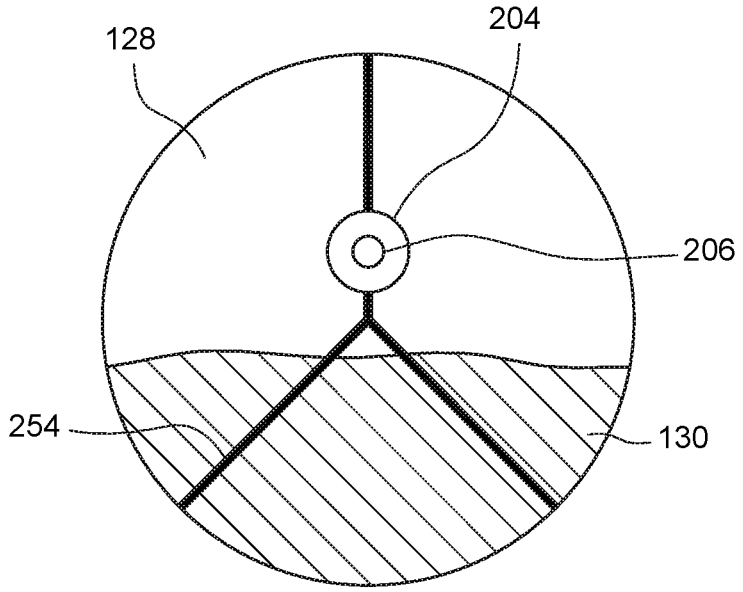
FIG. 5 is a cross-sectional view of a portion of an alternative gas vent system that may be used with the horizontal well shown in FIG. 1, in accordance with one or more embodiments shown or described herein.

Similarly, illustrated in FIG. 4 is a cross-sectional view of the configuration of the gas vent conduit 204, of the gas vent system 250 as shown in FIG. 2 along line "B-B". Again, a plurality of spacers 254 are configured to situate the gas vent conduit 204 within the wellbore 104 such that the gas vent intake passage 205 may entirely open to the gaseous substance 128 headspace, well above the liquid level 130. Alternatively, FIG. 5 illustrates a cross-sectional view of another configuration of the gas vent conduit 204 and the gas probe conduit 206. In this alternative embodiment, the gas probe conduit 206 is embedded wholly inside (i.e., situated annularly inward from) the gas vent conduit 204 with the conduit spacers (not shown) between the two conduits to support the structure of the combination gas probe conduit 206 and gas vent conduit 204. In an embodiment, the gas probe conduit 206 and the gas probe conduit 206 are concentric. In another alternative embodiment, as shown in FIG. 6, both the gas probe conduit 206 and the gas vent conduit 204 may be embedded into the casing 122 of the wellbore 104. In this configuration, the installation of the casing would advantageously include the installation of the gas vent system.

Referring now to FIGS. 7-9, in an attempt to obtain stable control of the gas vent system 200, the controller 214, and more particularly the system control logic, seeks to maintain the level of liquid 130 in the inclined region, and more particularly the updip 113 of the wellbore 104 where the venting conduits 204, 206 are placed. As previously stated, initially the controller 214 determines the mode of operation, and generates in response thereto, and more particularly based on the relation between the gas venting rate and downhole pressure (PDH), one or more control signals to open or close one or more of the choke valve(s) 224, 226 based on any number of control algorithms.

FIGS. 7 and 8 are detailed schematic views of the gas vent system 200 within a portion of the horizontal portion 108 of the wellbore 104 representing two different modes of operation of the gas vent system 200, as described herein. For example, FIG. 7 illustrates both the properly installed gas vent conduit 204 and the gas probe conduit 206 in a horizontal portion of a wellbore during a first mode of operation 10, and more particularly, during a startup, or gradient, mode of operation, as determined by the controller 214. FIG. 8 illustrates both the properly installed gas vent conduit 204 and the gas probe conduit 206 in a horizontal portion of a wellbore during a second mode of operation 20, and more particularly, during a normal, or level, mode of operation, as determined by the controller 214.

Referring more specifically to FIG. 7, in startup or gradient mode 10, the relationship between the gas venting rate and the downhole pressure (PDH) is dominated by the gradient "G" of a fluid column 131 above the liquid level 130 in the updip 113. As illustrated in FIG. 7, the liquid level 130 is at a lower limit, and more particularly, at substantially the same elevation as the valley 120 of the undulations. Some portion of the total gaseous substances 128 produced by the well is passing by the valley 120 (shown in FIG. 7 proximate the bottom of the arrow x). This condition is undesirable, as the gaseous substances 128 passing by may be unsteady such that pockets, or slugs, 12 of gas migrate up through the fluid column 131 and can interfere with the operation of pumping equipment, such as the pump 132, located within the fluid column 131. Under the assumption that the level of liquid portion 130 is known to be at the bottom of the undulation, and more particularly at the valley 120 as shown in FIG. 7, and a pump intake pressure (PIP) measurement is available at a known height above this level shown in FIG. 7 by "x", the value of the gradient "G" may be calculated using the formula:

$$G = \frac{(PDH - PIP)}{x}$$

Where:

PDH=downhole pressure

PIP=pump intake pressure

G=Gradient (weight of fluid 130 in fluid column 131)

x=distance between pump and surface level of liquid portion 130

During this startup, or gradient, mode 10 of operation, from a particular starting condition (set of pressures and flowrates), if the gas venting rate is increased, then more of the total gaseous substances 128 produced by the well 102 will travel through the gas vent conduit 204 and less gaseous substances 128 will migrate under the bottom of the undulation, the valley 120, and up the fluid column 131. Since the fluid column 131 will now contain less gaseous substances 128, the weight of the fluid 130 (gradient) will increase. Contrarily, from a particular starting condition, if the gas venting rate is decreased, then less of the total gaseous substances 128 produced by the well 102 will travel through the gas vent conduit 204 and more gaseous substances 128 will migrate under the bottom of the undulation, the valley 120, and up the fluid column 131. With more gaseous substances 128 content in the fluid column 131, the weight of the fluid 130 (gradient) will decrease. While operating in this startup, or gradient, mode 10 of operation, the level of the fluid 130 will remain at that bottom of the undulation, and the measured downhole pressure (PDH) will vary directly with the gas venting rate. During this startup, or gradient, mode 10 of operation, for a given pump intake pressure (PIP), a higher gas vent rate equals a higher downhole pressure (PDH).

Referring still to FIG. 7, with additional numerical reference to FIG. 1, to determine the mode of operation, and the presence of gas slugging, the gas venting rate is determined by the degree of opening of the gas vent control valve 222 on the gas vent conduit 204, preferentially located at the surface level 110, and can be directly measured using a variety of sensors, and more particularly sensors 210, 212, (e.g. the pressure drop across an orifice) or inferred from the position of the gas vent control valve 222. The downhole pressure (PDH) is additionally determined and can be estimated by measuring the flow rate of the gaseous substance 128 through the gas vent conduit 204, exit temperature and pressure of the gaseous substance 128 (on the surface 110) exiting the gas vent conduit 204 and using flow equations. Alternatively, the downhole pressure (PDH) can be measured preferentially at the surface level 110 by a device such as a pressure transducer (not shown).

During the first mode of operation 10, pump 132 is situated a distance "x" above the surface level of the liquid portion 130 of the horizontal portion 108 of the wellbore 104. The gas vent intake passage 205 of the gas vent conduit 204 and the gas probe intake passage 207 of the gas probe conduit 206 are both exposed to only the gaseous substances 128 portion of the horizontal portion of the wellbore. More specifically, in this first mode of operation 10, the gas probe intake passage 207 is situated by a first distance 240 above the surface level of the liquid portion 130 of the horizontal portion 108 of the wellbore 104. Because the gas probe intake passage 207 is fully exposed to the gaseous substances 128 and the pressure of gaseous substances 128 is higher than the atmospheric pressure on the surface, the gaseous substances 128 flow through the gas probe conduit 206 and the gas probe intake passage 207.

During this first mode of operation 10, the pump 132 is initiated and the gas slugging 12 may begin to occur. In an embodiment, the wellhead 138 may include a slug gas outlet (not shown) to relieve any pressure buildup at the surface end of the wellbore 104 experienced with the gas slugs 12.

More particularly, the sensor 210 (FIG. 1), located on the surface, may begin to determine the mode of operation by calculating the downhole pressure (PDH) and measuring the flow rate of the gaseous substances 128 through the gas probe conduit 206. Thereafter, the sensor 210 generates a measurement signal for the controller 214. In response to receiving this measurement signal from the sensor 210, the controller 214 generates a control signal command, based on one or more executing control routines via processor 216 and memory 218, that indicates the partial opening of gas vent choke valve 226.

As a result, the free flow of gaseous substances 128 may occur through the gas vent conduit 204. Substantially simultaneously, the controller 214 also may generate a control signal to instruct the gas probe choke valve 224 to partially open and allow the gaseous substances 128 to free flow as well. As a result, the flow rate through the gas probe conduit 206 is measured by the sensor 210, and the controller 214 receives measurement. In turn, the controller 214 continues measuring both the conduits 204, 206 and automatically and incrementally opens the gas vent choke valve 226 to increase the evacuation of the gaseous substances (while continually minimizing gas slugging and optimizing liquid production rate through the pump 132). During this first mode of operation 10, where gas slugging is present, as the choke valve(s) 224, 226 are opened, the amount of gas in the vertical portion 106 of the wellbore 108 decreases, the gradient (G) increases, the distance "x" between the pump 132 and the level of liquid 130 remains steady, and the downhole pressure (PDH) rises.

In addition, as the choke valve(s) 224, 226 are opened and the gaseous substances 128 are removed from the horizontal portion of the wellbore 104 (e.g., the head space of peak 118), the pressure of the gaseous substances 128 begins decreasing and the liquid level in the horizontal portion of wellbore 108 begins rising relative to elevation, as best illustrated in FIG. 8. During this second mode of operation 20, where gas slugging is not present, as the choke valve(s) 224, 226 are opened, the amount of gas in the vertical portion 106 of the wellbore 108 remains steady, the gradient (G) remains steady, the distance "x" between the pump 132 and the level of liquid 130 decreases, and the downhole pressure (PDH) decreases.

More particularly, during the normal, or level, mode of operation 20, the relationship between the gas venting rate and the downhole pressure (PDH) is dominated by the height that the liquid level 130 is allowed to rise within the undulation, or updip 113 of the wellbore 104. As illustrated in FIG. 8, during the normal, or level, mode of operation 20 the liquid level 130 is above the lower limit, at an elevation above the valley 120. All of the gaseous substances 128 produced by the well 102 are contained within the updip 113, with nearly all of the gaseous substances 128 carried by the gas vent conduit(s) 204 to the surface 110. As illustrated, in this second mode of operation 20, the gas probe intake passage 207 is situated by a second distance 242 above the surface level of the liquid portion 130 of the horizontal portion 108 of the wellbore 104, wherein the first distance 240 (FIG. 7) is greater than the second distance 242. Because the gas probe intake passage 207 is fully exposed to gaseous substances 128 and the pressure of gaseous substances 128 is higher than the atmospheric pressure on the surface, the gaseous substances 128 flow through the gas probe conduit 206 and the gas probe intake passage 207.

As previously indicated, the objective of the control system as disclosed herein is to modulate the venting rate of the gaseous substances 128 to equal the total gas production rate of the well 102. If the venting rate of the gaseous substances 128 is higher than the total gas production rate of the well 102, then the volume of the gaseous substances 128 contained within the updip 113 will decrease, the liquid level 130 in the updip 113 will rise such that the height "x" of the fluid column 131 from the liquid level 130 to the intake location of the pump 132 is reduced, and therefore the downhole pressure (PDH) is reduced. If the height "x" is allowed to reduce to a level such that the liquid level will rise and enters the gas vent tube 240 through the intake 205, the liquid will block the passage preventing the gas from escaping through the conduit. Contrarily, if the venting rate of the gaseous substances 128 is lower than the total gas production rate of the well 102, the volume of the gaseous substances 128 contained within the updip 113 will increase, which will push down the liquid level 130 in the updip 113, and the downhole pressure (PDH) is increased. It is noted that in both of these circumstances, there is substantially zero free gaseous substance 128 migrating under the valley 120 of the undulation and up the fluid column 131, and so the effective fluid gradient "G" remains nearly constant. During this normal, or level, mode 20 of operation, for a given pump intake pressure (PIP), a higher gas vent rate equals a lower downhole pressure (PDH).

As the pressure decreases in the head space of peak 118 (downhole pressure (PDH)), the flow rate measured by the sensor 210 decreases and the controller 214 instructs the gas vent choke valve(s) 224, 226 to close. Advantageously, in this manner, the gas vent system 200 regulates the opening and closing of the check valve(s) 224, 226 based on the mode of operation (the presence of gas slugging) and the gas venting rate.

As shown in FIG. 8 the level of liquid portion 130 contained in the horizontal portion of the wellbore 108 has risen in elevation because the gas vent choke valve 226 has allowed sufficient amount of the gaseous substances 128 to escape to the surface, causing the pressure of the gaseous substances 128 to decrease.

The gas probe choke valve 224 may be opened by a command from the controller 214, and flow rate measurements may be obtained from the gas probe sensor 210. The controller 214 may again incrementally open (or close) the gas vent choke valve 226 based at least on the downhole pressure (PDH) and a flow rate measurement of the gas flowing through gas probe conduit 206 in attempting to discover an equilibrium setting for evacuating gaseous substances 128 at the maximum rate without flooding gas probe conduit 206. Because the rate of the production zones may change or other wellbore conditions may change, the controller 214 includes the ability to dynamically change the valve positions, etc. in determining the equilibrium setting for evacuating gaseous substances 128. The changing well conditions could also lead to the controller switching between mode of operations 10 and 20. As previously noted it is important for the controller to determine whether it is operating in gradient mode, the first mode of operation 10, or level mode, the second mode of operation 20. This determination is made by constantly varying the opening of the gas vent choke valve(s) 224, 226 above and below the value calculated by the controller 214 as described by the process described above, such that the mean of the imposed variations over time is zero. The varying opening of the gas vent choke valve(s) 224, 226 will lead to an oscillating gas vent rate and hence an oscillation in the downhole pressure. In the first mode of operation 10, the increase in venting rate leads to an increase in the downhole pressure (PDH), while in the second mode of operation 20, the increase in venting rate leads to decrease in downhole pressure (PDH). The phase difference between the oscillation of choke opening command and downhole pressure (PDH) estimate will change depending on the mode of operation. This phase difference can be used to make the determination of the mode.

Referring now to FIG. 9, illustrated graphically are simulation results for the gas vent system 200, generally referenced 350. As indicated at line 352, during the first mode of operation 10, or in gradient mode, as one or more of the choke valve(s) 224, 226 is gradually opened, the gradient "G" increases, as plotted at line 354. Furthermore, the fluid level of the fluid 130 remains steady, as plotted at line 356, while the downhole pressure (PDH) increases, as plotted at line 358. As indicated at line 352, during the second mode of operation 20, or in normal/level mode, as one or more of the choke valve(s) 224, 226 is opened, the gradient remains steady, as plotted at line 354. Furthermore, the fluid level of the fluid 130 decreases, as plotted at line 356, while the downhole pressure (PDH) decreases, as plotted at line 358.

Accordingly, the ability to control the system is each operation mode is achieved, subsequent to establishing the mode of operation so as to modulate the venting rate of the gaseous substances 128 to equal the total gas production rate of the well 102. Referring now to FIG. 10, illustrated is a portion of an alternate embodiment of a gas vent system, during the first mode of operation 10, including a forward deployed sensor. More particularly, illustrated is a portion of a gas vent system, generally referenced 300, including a forward deployed sensor 302. Similar to the previous embodiment, initially the controller 214 determines the mode of operation and the gas venting rate, and generates in response thereto, one or more control signals to open or close one or more of the choke valve(s) 224, 226 based on any number of control algorithms. During the level mode, and more particularly, the second mode of operation 20, the gradient "G" cannot be estimated using the pump intake pressure (PIP) and downhole pressure (PDH) due to the change in the liquid level "x", where x is equal to the distance between the pump 132 and the surface level of liquid portion 130. The forward deployed sensor 302, positioned a distance "y" from the first sensor 210 (FIG. 1), provides gradient calculation in that the distance is always the same. Accordingly, the value of the gradient "G" may be calculated using the formula:

$$G = \frac{(P2 - PIP)}{y}$$

Where:

P2=Pressure value of forward deployed sensor 302

PIP=pump intake pressure

G=Gradient (weight of fluid 130 in fluid column 131)

y=distance between forward deployed sensor and surface level sensor

As the choke valve(s) 224, 226 are opened and the gaseous substances 128 are removed from the horizontal portion of wellbore 108 (e.g., the head space of peak 118), the pressure of the gaseous substances 128 begins decreasing and the liquid level in the horizontal portion of wellbore 108 begins rising relative to elevation, as previously described with regard to FIG. 8, and the second mode of operation 20.

Referring now to FIG. 11, illustrated graphically are simulation results for the gas vent system 300, generally referenced 360. As indicated at line 362, during the first mode of operation 10, or in gradient mode, as one or more of the choke valve(s) 224, 226 is gradually opened, the gradient increases, as plotted at line 364. Furthermore, the fluid level of the fluid 130 remains steady, as plotted at line 366, while the downhole pressure (PDH) increases, as plotted at line 368. As indicated at line 362, during the second mode of operation 20, or in normal/level mode, as one or more of the choke valve(s) 224, 226 is opened, the gradient remains steady, as plotted at line 364. Furthermore, the fluid level of the fluid 130 decreases dramatically and then remains steady, as plotted at line 366, while the downhole pressure (PDH) remains steady, as plotted at line 368.

The above relations are used to devise a startup and stable operational control sequence. During system startup, such as when the system is initially deployed in a well completion, or has otherwise not been operating in "normal operating" mode, the gas vent conduit 204 and/or the gas probe conduit 206 may become flooded with liquids within the wellbore 104. This can be detected by direct measurement of near zero gas flow exiting the venting conduits 204, 206 at the surface 110. A "purge" operation can then be used to clear the liquids from the gas vent conduit 204 and/or the gas probe conduit 206 by introducing high pressure gas from the surface to blow liquids back out of the end of the conduits 204, 206 into the wellbore 104. As best illustrated in FIGS. 7 and 8, the larger gas vent conduit 204 may extend further up the updip 113 in the wellbore 104, and the smaller gas probe conduit 206 may terminate at a lower elevation within the updip 113. This would allow changes in flow during normal operation to be detected by flooding the smaller gas probe conduit 206 only, then purged, with the control set point updated (described presently). By minimizing, if not eliminating, the possibility of flooding of the larger gas vent conduit 204, gas venting may be maintained in the larger gas vent conduit 204 while the smaller gas probe conduit 206 is purged, resulting in less disturbance to the well production, and ultimately leading to system that can be stably controlled amidst more rapid changes to instantaneous gas and liquid flowrates. As previously described, in an alternative embodiment, a system may include a single venting conduit. Additional information on the purging of the gas vent conduit 204 and/or the gas probe conduit 206 may be found in copending U.S. patent application Ser. No. 14/969,915, James Rollins Maughan, et al., "Surface Pressure Controlled Gas Vent System for Horizontal Wells," which is incorporated herein in its entirety. A high-pressure pipeline 234 may also be utilized in purging either conduit 204, 206. Additionally or alternatively, any excess gaseous substances 128 evacuated from the wellbore may be disposed of through a flare 236.

Referring now to FIG. 12, a method 400 is now described whereby the fundamental system response characteristics can be identified by changing inputs and monitoring output measurements. Subsequent to any purging required during system startup, it is next necessary to determine which "state of operation" the system is in so that the right "mode" of control can be used. An initial target is selected for the downhole pressure (PDH) set point, at step 402. The initial target set point is based on knowledge of the well geometry, fluids, and equipment positioning. A target phase difference, gradient or ESP current is next selected in step 404. Subsequently in step 406, the gas venting rate is set at an initial set point. If using the phase difference approach, the gas venting rate is cycled above and below the target set point, for example in a sinusoidal cycle. In an embodiment, a constantly varying perturbation, for example in a sinusoidal cycle, is superimposed on this target rate. The phase difference is next calculated if a target phase has previously been set, or the gradient is next calculated where a target gradient has been previously set, or the motor current is measured where a target ESP current has been previously set, in step 408. Next, in a step 410, the controller compares the calculated phase difference to the target phase difference, or the calculated gradient to the target gradient, or the measured current to the target ESP current. The operation mode is determined based on these calculations. More particularly, if a calculated phase difference between oscillations in downhole pressure (PDH) and oscillations in the target venting rate set point is less than the target phase difference, or the calculated gradient is less than the target gradient, or the ESP current is less than the target ESP current, then a startup/gradient mode determination is made. If a calculated phase difference between oscillations in downhole pressure (PDH) and oscillations in the target venting rate set point is more than the target phase difference, or the calculated gradient is greater than the target gradient, or the ESP current is greater than the target ESP current, then a normal/level mode determination is made.

If the "gradient mode" determination is made, then the control law for gradient mode, and more particularly the first mode of operation 10, is employed, at step 412. As previously alluded to, the goal is to change the state of the system from "startup/gradient mode" to "normal/level mode". If the "startup/gradient mode" determination is made, the gas venting rate is increased in order to increase the downhole pressure (PDH) (according to the gradient mode control law), in a step 414. The amount of free gas that is migrating under the trough, or valley, of the undulation is thereby reduced and the liquid level in the undulation then rises, as previously described in FIG. 8. If the "normal/level mode" determination is made, then the control law for level mode, and more particularly the second mode of operation 20, is employed, at step 416. As the state of the system changes the measured downhole pressure (PDH) is compared with the target downhole pressure (PDH) in a step 418 and the gas venting rate is increased or decreased, in a step 420, in order to increase or decrease the downhole pressure (PDH) (according to the level mode control law).

In step 410, if the measured gas venting rate from the vent conduit(s) decreases and a zero flow rate is detected in a step 422, this indicates that the liquid level in the updip has risen above the opening of the vent conduit in the wellbore, flooding the tube with liquid. In this instance, purging of the system, in a step 424 is required as previously described with regard to FIGS. 7 and 8. Subsequent to purging, a new target lower set point for the downhole pressure (PDH) may then be selected, as in step 406, to avoid another flooding incident and the phase difference, gradient, or ESP current is recalculated/remeasured in step 408.

The above-described horizontal well systems facilitate efficient methods of well operation. Specifically, in contrast to many known well completion and production systems, the horizontal well systems as described herein substantially remove gaseous substances from a wellbore that substantially reduces the formation of gas slugs in the wellbore by providing a startup and stable operational control sequence. The control system as disclosed herein provides for the modulation of the venting rate of the gaseous substances to equal the total gas production rate of the well.

As such, the gas vent system described herein provides gaseous substances with an escape path that bypasses the pump and removes substantially all of the gaseous substances from within the horizontal portion of the wellbore prior to the gases reaching the pump such that only the liquid mixture encounters the pump. Accordingly, the gas vent systems described herein substantially eliminate both the buildup of pressure upstream from the pump and the formation of slugs, as described above. More specifically, the gas vent systems described herein substantially reduce the buildup of pressure within the wellbore such that the horizontal portion of the wellbore achieves a nearly constant minimum pressure along its length that maximizes the production rate and the total hydrocarbon recovery of the horizontal well.

An exemplary technical effect of the methods, systems, and apparatus described herein includes at least one of: (a) maximizing the production rate of a well by achieving a constant minimum pressure along a horizontal length of the wellbore; and (b) reducing the operational costs of the well by protecting the pump from inhaling gas slugs that may cause a reduction in the expected operational lifetime of the pump.

Exemplary embodiments of methods, systems, and apparatus for removing gas slugs from a horizontal wellbore are not limited to the specific embodiments described herein, but rather, components of systems and steps of the methods may be utilized independently and separately from other components and steps described herein. For example, the methods may also be used in combination with other wells, and are not limited to practice with only the horizontal well systems and methods as described herein. Rather, the exemplary embodiment can be implemented and utilized in connection with many other applications, equipment, and systems that may benefit from creating independent gas and liquid flow paths.

Although specific features of various embodiments of the disclosure may be shown in some drawings and not in others, this is for convenience only. In accordance with the principles of the disclosure, any feature of a drawing may be referenced and claimed in combination with any feature of any other drawing.

Some embodiments involve the use of one or more electronic or computing devices. Such devices typically include a processor or controller, such as a general purpose central processing unit (CPU), a graphics processing unit (GPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer readable medium, including, without limitation, a storage device and/or a memory device. Such instructions, when executed by a processor, cause the processor to perform at least a portion of the methods described herein. The above examples are exemplary only, and thus are not intended to limit any way the definition and/or meaning of the term processor.

It is understood that in the flow diagram shown and described herein, other processes may be performed while not being shown, and the order of processes can be rearranged according to various embodiments. Additionally, intermediate processes may be performed between one or more described processes. The flow of processes shown and described herein is not to be construed as limiting of the various embodiments.

This written description uses examples to disclose embodiments, including the best mode, to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of controlling a gas vent system to vent gas from a wellbore that includes a substantially horizontal portion, the wellbore configured to channel a mixture of fluids, said method comprising:

determining an initial operating mode of the gas vent system, wherein the step of determining an initial operating mode includes determining a downhole pressure (PDH) and a gas venting rate of the gas vent system, wherein determining a downhole pressure (PDH) includes determining an initial target downhole pressure (PDH) set point, and wherein determining the gas venting rate includes setting the gas venting rate to one of: (i) fluctuate above an initial target gas venting rate set point (ii) fluctuate below an initial target gas venting rate set point, or (iii) remain at an initial target gas venting rate set point, and measuring, and comparing a dynamic response of the downhole pressure (PDH) to the gas venting rate;

generating one or more control signals established for the determined initial operation mode; and transmitting the one or more control signals to a gas vent choke valve that commands a closing or opening of the gas vent choke valve.

2. The method in accordance with claim 1 wherein measuring and comparing a dynamic response of the downhole pressure (PDH) to the gas venting rate include at least one of:

calculating and comparing a phase difference in oscillations in downhole pressure (PDH) with oscillations in the initial target venting rate set point;

calculating and comparing a gradient with a target gradient; or calculating and comparing a measured current with a target electric submersible pump (ESP) current.

3. The method in accordance with claim 2, further comprising employing one or more control laws for a gradient mode of operation as a result of:

a calculated phase difference between oscillations in downhole pressure (PDH) and oscillations in the target gas venting rate set point less than a target phase difference;

a calculated gradient less than the target gradient; or a calculated ESP current less than the target electric submersible pump (ESP) current.

4. The method in accordance with claim 3, further comprising changing the operating mode of the gas vent system from the gradient mode to a level mode by increasing the gas venting rate to decrease the downhole pressure (PDH).

5. The method in accordance with claim 2, further comprising employing one or more control laws for a level mode of operation as a result of:

a calculated phase difference between oscillations in downhole pressure (PDH) and oscillations in the target gas venting rate set point is more than a target phase difference;

a calculated gradient greater than the target gradient; or a calculated ESP current greater than the target electric submersible pump (ESP) current.

6. The method in accordance with claim 1, further comprising:

positioning a gas vent conduit within the wellbore, the gas vent conduit including a gas vent intake passage situated within the substantially horizontal portion of the wellbore; and facilitating a first flow of gaseous substances through the gas vent conduit, wherein the first flow of gaseous substances through the gas vent conduit is controlled by the gas vent choke valve situated outside the wellbore.

7. The method in accordance with claim 6, further comprising purging the gas vent conduit with a pressurized gas in response to a determination that a gas vent flow measurement is substantially zero or significantly decreases.

8. The method in accordance with claim 6, further comprising:

positioning a gas probe conduit within the wellbore, the gas probe conduit including a gas probe intake passage within the substantially horizontal portion of the wellbore, wherein the gas probe intake passage is situated at a different location than the gas vent intake passage; and facilitating a second flow of gaseous substances through the gas probe conduit.

9. The method in accordance with claim 8, therein the gas probe conduit includes a diameter different from a diameter of gas vent conduit.

10. The method in accordance with claim 8, wherein the gas vent conduit and the gas probe conduit are embedded within a casing of the wellbore.

11. The method in accordance with claim 8, wherein the gas probe conduit is situated annularly inward from the gas vent conduit.

12. A method of controlling a gas vent system that includes a gas vent choke valve to vent gas from a wellbore that includes a substantially horizontal portion, the wellbore configured to channel a mixture of fluids, said method comprising:

determining an initial operating mode of the gas vent system by determining an initial target downhole pressure (PDH) set point, setting a gas venting rate to fluctuate above and below the initial target downhole pressure (PDH) set point and measuring and comparing a dynamic response of the downhole pressure (PDH) to the gas venting rate;

generating one or more control signals established for the determined initial operation mode; and transmitting the one or more control signals to a gas vent choke valve that commands a closing or opening of the gas vent choke valve.

13. The method in accordance with claim 12, wherein generating one or more control signals established for the determined initial operation mode comprises:

employing one or more control laws for a gradient mode of operation as a result of:

a calculated phase difference between oscillations in downhole pressure (PDH) and oscillations in the target gas venting rate set point less than a target phase difference;

a calculated gradient less than the target gradient; or a calculated ESP current less than the target electric submersible pump (ESP) current, or employing one or more control laws for a level mode of operation as a result of:

a calculated phase difference between oscillations in downhole pressure (PDH) and oscillations in the target gas venting rate set point is more than a target phase difference;

a calculated gradient greater than the target gradient; or a calculated ESP current greater than the target electric submersible pump (ESP) current.

14. The method in accordance with claim 12, wherein employing one or more control laws for a gradient mode of operation further comprises:

changing the operating mode of the gas vent system from the gradient mode to a level mode by increasing the gas venting rate to decrease the downhole pressure (PDH).

15. A controller for use in venting gas from a wellbore, the wellbore including a substantially horizontal portion, the wellbore configured to channel a mixture of fluids, said controller configured to:

determine an initial operating mode of a gas vent system by determining a downhole pressure (PDH) and a gas venting rate of the gas vent system;

generate one or more control signals established for the determined initial operation mode;

detect whether a periodic increase in the gas venting rate results in one of an increase or a decrease of the downhole pressure (PDH) by calculating and comparing one of:

calculating and comparing a phase difference in oscillations in downhole pressure (PDH) with oscillations in the initial target venting rate set point calculating and comparing a gradient with a target gradient; or calculating and comparing a measured current with a target electric submersible pump (ESP) current, and employ one or more control laws for one of:

a gradient mode of operation as a result of one of a calculated phase difference between oscillations in downhole pressure (PDH) and oscillations in the target gas venting rate set point less than a target phase difference, a calculated gradient less than the target gradient, or a calculated ESP current less than the target ESP current, or a level mode of operation as a result of one of a calculated phase difference between oscillations in downhole pressure (PDH) and oscillations in the target gas venting rate set point is more than a target phase difference, a calculated gradient greater than the target gradient, or a calculated ESP current greater than the target ESP current; and transmit the one or more control signals to a gas vent choke valve that commands a closing or opening of the gas vent choke valve.

16. The controller in accordance with claim 15, wherein employing one or more control laws for a gradient mode of operation further comprises changing the operating mode of the gas vent system from the gradient mode to a level mode by increasing the gas venting rate to decrease the downhole pressure (PDH).

* * * * *